United States Patent [19]

Haunold et al.

[11] 4,182,129

[45] Jan. 8, 1980

[54] HEAT EXCHANGER

[75] Inventors: Otto Haunold, Carlsbad; Malbone W. Greene, Vista, both of Calif.

[73] Assignee: Beckman Instruments, Inc., Fullerton, Calif.

[21] Appl. No.: 931,332

[22] Filed: Aug. 7, 1978

[51] Int. Cl.[2] ..... F25B 21/02; F25D 17/06; F25D 17/00; F28D 7/12

[52] U.S. Cl. ..... 62/3; 62/96; 62/180; 62/406; 165/142

[58] Field of Search ..... 165/142; 62/3, 514, 62/96, 180, 406

[56] References Cited

U.S. PATENT DOCUMENTS

| | | | |
|---|---|---|---|
| 3,223,081 | 12/1965 | Hunt | 165/142 X |
| 3,228,400 | 1/1966 | Armao | 62/514 X |
| 3,261,180 | 7/1966 | Porter et al. | 62/514 |
| 3,319,709 | 5/1967 | Strunk | 165/142 |
| 3,747,670 | 7/1973 | Palm et al. | 165/142 |
| 4,142,580 | 3/1979 | Bailey | 165/142 |

*Primary Examiner*—Lloyd L. King

*Attorney, Agent, or Firm*—R. J. Steinmeyer; Robert S. Frieman

[57] ABSTRACT

A heat exchanger comprising:

(a) a housing having an interior surface;

(b) a thermally conductive member in intimate contact with the housing;

(c) a thermally conductive element coaxially disposed in said housing and having an inner and an outer surface and in thermal communication with the member, wherein the inner surface of the element defines a first fluid passage, and wherein the interior surface of the housing and the outer surface of the element are in spaced relationship thereby defining a second fluid passage, the first and second fluid passages being in fluid communication;

(d) a first port for maintaining the first fluid passage in fluid communication with a first external fluid;

(e) a second port for maintaining the second fluid passage in fluid communication with a second external fluid; and (f) means for regulating the member's temperature; wherein heat is transferred between the member and the element via solid conduction.

9 Claims, 3 Drawing Figures

HEAT EXCHANGER

BACKGROUND OF THE INVENTION

1. Field of the Invention

This invention relates to heat exchangers and more particularly to a compact heat exchanger adapted for use within light weight, semi-portable instrument enclosures.

2. Description of the Prior Art

Prior art heat exchangers generally employ a mobile fluid to either heat or cool a second fluid of a lower or higher temperature, respectively, through a thin wall. These heat exchangers tend to be too expensive and too bulky for use within instrument enclosures especially if it is desired that the instrument be light weight and semi-portable.

Presently available heat exchangers employing solid conduction as their means for heat exchange are relatively light weight but generally have been too inefficient for use where a relatively high volume of fluid flow is required.

Therefore, a compact, light weight heat exchanger, employing solid conduction as its means of heat exchange, capable of efficiently regulating relatively high volumes of fluid flow would be highly desirable for use where low weight and minimum space requirements are considered essential such as within a light weight, semi-portable instrument enclosure.

SUMMARY OF THE INVENTION

The instant invention encompasses a compact, light weight, highly efficient heat exchanger particularly suitable for use within a instrument enclosure.

In accordance with the present invention the heat exchanger comprises a housing having an interior surface; a thermally conductive member in intimate contact with the housing; and a thermally conductive element having an inner and an outer surface in thermal communication with the member. A first fluid passage is defined by the inner surface of the element and a second fluid passage is defined by the interior surface of the housing and the outer surface of the element. The first and second fluid passages are in fluid communication.

Heat is transferred between the member and the element via solid conduction.

The heat exchanger of the instant invention has a high heat exchange surface area to volume ratio thereby enabling it to efficiently regulate relatively high volumes of fluid flow. Because of its resultant compactness and light weight, the heat exchanger of the instant invention is also suitable for use within an instrument housing, especially a semi-portable instrument enclosure.

BRIEF DESCRIPTION OF THE DRAWINGS

In the drawings, like numbers denote like parts and lettered numbers denote other embodiments of the corresponding numbered items.

DESCRIPTION OF THE PREFERRED EMBODIMENTS

Figure 1:
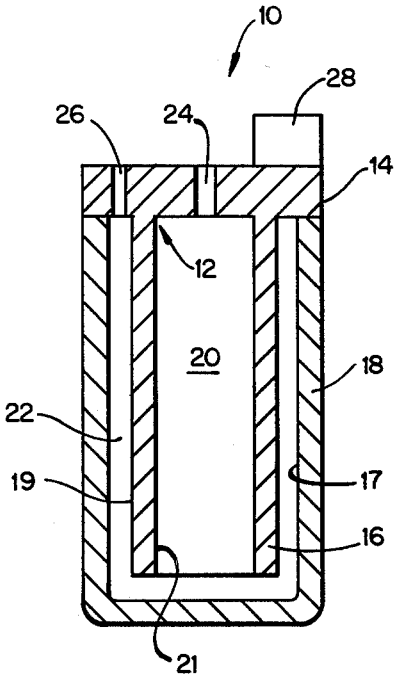
FIG. 1 is a cross-sectional view of a heat exchanger within the scope of this invention.

Referring to FIG. 1, the present invention is embodied in a new and efficient heat exchanger 10 which is particularly suited for mounting in a semi-portable instrument enclosure, not shown. The heat exchanger 10 comprises a thermally conductive member 12 comprising a top plate portion 14 and an elongate tubular member 16 extending from one surface of the plate 14 and being open at its extending end. Housing 18 contains the tubular member 16 with the exterior wall 19 of the tubular member 16 in spaced relation to the interior wall 17 of the housing 18. The plate member 14 is in intimate thermal contact with the housing 18 at the housing's open end and serves as a wall of the housing. The thermally conductive member 12 is formed from any conductive material, i.e., a material having a thermal conductivity of 1.5 w/cm$^2$ °C/cm or greater, and preferably the conductive member 12 is formed from a material such as copper or aluminum alloy. The housing 18 can be formed of any suitable material irrespective of its thermal conductivity. However, for best heat exchange efficiency, it is preferred that the housing 18 be also formed of a thermally conductive material such as the material mentioned in connection with the thermally conductive member 12. Housing 18 can consist of one or more layers of material which can either have the same or different thermal conductivities. In one embodiment it is preferred that the housing 18 consist of at least an inner layer and an outer layer wherein said outer layer is thermally nonconductive and wherein said inner layer is thermally conductive.

A first fluid passage 20 is defined by the bore of the tubular member 16 and a second fluid passage 22 is defined between the wall 17 of the housing 18 and the exterior surface 19 of the tubular member 16. The open extending end of the tubular member 16 disposed in the housing 18 is spaced from the bottom surface of the housing 18 to provide fluid communication between the first fluid passage 20 and the second fluid passage 22. The first fluid passage 20 communicates to the exterior of the heat exchanger 10 through a first port 24 provided in the plate 14 of the conductive member 12 and the second fluid passage 22 communicates to the exterior through a corresponding second port 26 extending through the plate member 14. Ports 24 and 26 may be provided with suitable nipples or line connections, not shown, for fluid communication with external fluid reservoirs for the ingress and egress of fluid.

The temperature of the thermally conductive member 12 is maintained at a desired level by any thermal control means, shown schematically at 28. The thermal control means 28 can be any combination of conventional heat exchange systems, such as, for example, a circulating thermal exchange fluid which is in thermal communication with a heat source or heat sink. More preferably, the heat exchange system is an electronic heat pump, which is in thermal communication with a heat source or heat sink for controllably pumping heat energy to and from the thermally conductive plate 14.

In operation, a fluid which is to be adjusted to a desired temperature and/or moisture content, is introduced into the heat exchanger 10 through the port 24 from a source, not shown. The fluid enters the first fluid passage 20 defined by the bore of the tube 16 and expands against the inner surface 21 of the tube. The member 12 is maintained at a preselected temperature through its thermal contact with the thermal control means 28 and thus tubular member 16 is essentially at the preselected controlled temperature. Contact of the entering fluid against the interior surface 21 of member 16 results in a transfer of thermal energy and a resultant raising or lowering of the temperature of the fluid. In the case of a gas this also results in an increase or decrease in the relative humidity of the gas, as is well understood. The fluid flows through the first fluid passage 20 and enters the second fluid passage 22 where it additionally contacts the exterior surface 19 of the tube 16 and is further heated or cooled, depending upon the temperature of the member 12. The fluid exits the heat exchanger 10 through the port 26 and is led off for storage or service as the case may be. If the fluid is cooled in the heat exchanger 10, the thermal energy derived from the fluid is conducted through the conductive member 12 to the thermal control means 28 for dissipation through a suitable heat sink or the like. By the same token, if the fluid is heated by contact with the conductive member 12, thermal energy is supplied by the thermal control means 28 from a suitable heating element or thermal source.

It should be evident that the flow of fluid through the heat exchanger can be reversed with equivalent results. Thus fluid can initially be introduced through the port 26 for flow through the second fluid passage 22 to the first fluid passage 20 to service or storage through the port 24.

By virtue of the use of the conductive member 12 to transfer thermal energy and the design of the heat exchanger 10, the weight and bulk of the unit is maintained at a minimum. It will be apparent, however, that the efficiency of the heat exchanger 10 is dependent to a large extent upon the thermally controlled surface area which can be provided in the fluid passages 20 and 22 for contact with fluid being circulated. Although the surface area can be increased by merely scaling up the heat exchanger 10, increased surface area can be provided in accordance with the present invention without increasing the size of the heat exchanger.

Figure 2:
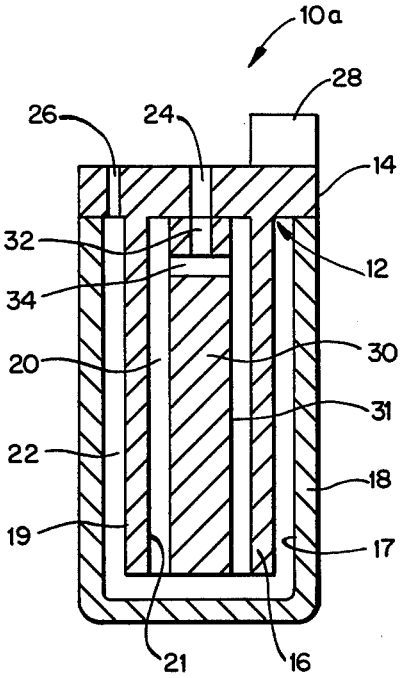
FIG. 2 is a cross-sectional view of another embodiment of the heat exchanger within the scope of this invention.

As most clearly shown in FIG. 2, the surface area of the heat exchanger **10*a* is substantially increased by the provision of a second conductive member 30 within the bore of the tubular element 16 of the conductive member 12. The second conductive member is also in intimate thermal contact with the plate 14 of the thermally conductive member 12 and may be integrally formed therewith or may be threadably engaged therein. The second conductive member 30 is provided with an axial fluid passage 32 which extends axially into the second conductive member 30 and intersects with a fluid distributing passage 34 which extends normal to the axis of the second conductive member 30 and communicates therethrough. The axial fluid passage 32 communicates with the port 24 in the plate 14**.

The heat exchanger **10*a* operates in substantially the same manner as the heat exchanger 10 described in connection with FIG. 1 and fluid to be heated or cooled enters the heat exchanger through the port 24 and axial passage 32 where it is distributed into the first fluid passage 20 by the fluid distributing passage 34. While in the first fluid passage 20, the fluid contacts both the interior wall 21 of the tube 16 of the conductive member 12 and the surface 31 of the second conductive member 30. The gas then passes into the second fluid passage 22 and exits the heat exchanger 10*a* through the port 24**.

The increase in surface area provided by the second conductive member 30 substantially increases the thermally controlled surface area for contact by the fluid being treated, thus substantially increasing the efficiency of the heat exchanger **10*a***.

It will be apparent that the capacity or flow rate of a given fluid through the heat exchanger of the present invention will be dependent in part upon the volume of the first and second fluid passage 20 and 22, respectively. These, of course, are determined by the dimensions of the tube 16, the housing 18 and the second conductive member 30. The dimensions of these elements, therefore, will be dependent upon the speciications and operating conditions to which the heat exchanger will be exposed. Heat exchange rates and other design considerations are based on calculations well known to those skilled in the art.

Figure 3:
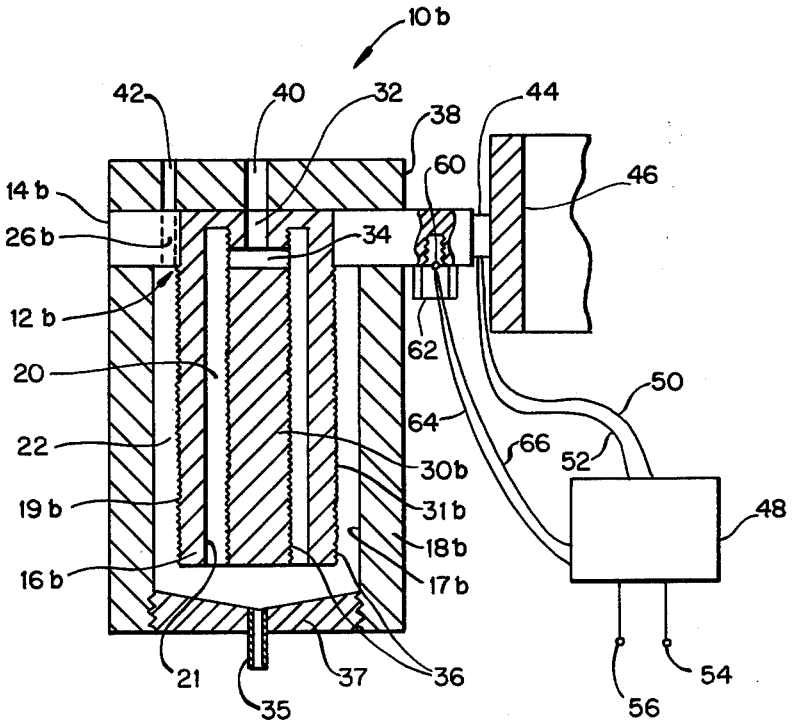
FIG. 3 is a partial cross-sectional view of a third embodiment of the heat exchanger within the scope of this invention.

Referring to FIG. 3, yet another embodiment of the heat exchanger of the present invention is illustrated wherein the surface area for contacting the gas to be treated is increased without increasing the size of the unit or decreasing the size of the fluid passages therein by configuring the heat exchange surfaces of the heat exchanger **10*b*** so as to increase the surface area thereof.

As is most clearly shown in FIG. 3, the heat exchanger **10*b* comprises the conductive member 12*b* which is received in the housing 18*b* and the second conductive member 30*b* coaxially disposed within the bore of the tube 16*b* of the conductive member 12*b* as described above in FIG. 2. The external surface 19*b* of the tube 16*b* and the external surface 31*b* of the second conductive member 30*b* have integrally formed thereon a plurality of raised areas 36 which further increase the surface area of the thermally controlled surfaces for contact with the fluid being treated and also cause some turbulence in the fluid flowing through the unit 10*b*. Most conveniently the raised portions 36 are formed by continuous helical threads which in effect not only increase the surface area in contact with the fluid but also aid in the exchange of thermal energy between the fluid contact surface and the fluid by creating an area of turbulent flow along the interface of fluid and the thermally controlled surface. Although not shown, it should be clear that the interior surface 21 of the tube 16*b* may likewise be provided with raised portions 36** for the purpose of increasing its surface area and improving the exchange of thermal energy.

The housing 18 as depicted in FIG. 3 further comprises an upper portion 38 disposed above and in intimate contact with plate **14*b* of conductive member 12*b*. Upper portion 38 is provided with ports 40 and 42 which communicate with axial fluid passage 32 and second port 26*b***, respectuflly.

Thermal control means are shown in FIG. 3 as comprising a thermoelectric device 44, e.g., a thermoelectric cooler, in thermal communication with plate **14*b* and heat reservoir 46. The thermoelectric device 44 is in signal communication with electric means 48, e.g., via electrical leads 50 and 52. The electric circuit means, which can be any temperature control circuit responsive to the temperature of member 12*b*, can derive power from leads 54 and 56. Electric circuit means 48 is operational in response to a means for determining the temperature of member 12*b*. The means for determining the temperature of member 12*b* can comprise a thermally sensitive resistor, e.g. a thermistor 60, in thermal communication with member 12***b* via any convenient means, e.g., a bolt 62. Thermistor 60 is in signal communication with electric circuit means 48, e.g., via electrical leads 64 and 66. Electric circuit means 48 responds to change(s) in the temperature of the thermistor 60 to drive electric current through leads 50 and 52 to selectively regulate the temperature of member 12*b*. As the temperature of thermistor 60 reaches a controlled setpoint, the current of electric circuit means 48 is reduced to a value required to maintain thermistor 60 (and member 12*b*) at a predetermined temperature.

In the embodiment illustrated in FIG. 3, the heat exchanger 10*b* is particularly adapted for collection of a liquid removed from a gas. As shown, the interior surface of the bottom wall is cone shaped so that a fluid condensing on the surfaces of the first fluid passage 20 and the second fluid passage 22 are collected in the center of the bottom wall of the housing 18. A duct 35 is provided for leading the collected liquid out of the heat exchanger 10*b*. In the embodiment shown in FIG. 3, the bottom wall is most conveniently formed as a separate element 37 which can be threadably engaged into the lower portion of the housing 10*b*.

Operation of the heat exchanger 10*b* is as described above for the heat exchanger 10*a* of FIG. 2 and as stated above, the heat exchanger is used to either heat or cool a fluid, or in the case of a gas, to control the liquid content of the gas.

The heat exchanger of the present invention is useful to control the temperarture of various fluids, such as, for example, air, nitrogen, water, chemical reagents, automobile exhaust, and other fluids wherein one wishes to control the temperature thereof or remove condensables therefrom. In a preferred embodiment of the invention, the heat exchanger is utilized to treat air by cooling it until its dew point is reached and the moisture contained therein condenses out of the gas. In this manner the humidity of the air is substantially reduced prior to passage of air through a cooled sample chamber of a photometric instrument. Unless treated in this manner, or otherwise pretreated to dry or remove moisture from the air, air circulated through a cool sample chamber will result in the fogging of a cuvette in the sample chamber which results in inaccurate light output from the sample being assayed therein.

Based on this disclosure, many other modifications and ramifications will naturally suggest themselves to those skilled in the art. These are intended to be comprehended as within the scope of this invention.

The embodiments of the invention in which an exclusive property or privilege is claimed are defined as follows:

1. A heat exchanger comprising:

(a) a housing having an interior surface;

(b) a thermally conductive member in intimate contact with said housing;

(c) a thermally conductive element coaxially disposed in said housing and having an inner and an outer surface and in thermal communication with said member, wherein said inner surface of said element defines a first fluid passage, and wherein said interior surface of said housing and said outer surface of said element are in spaced relationship thereby defining a second fluid passage; said first and second fluid passages being in fluid communication;

(d) a first port for maintaining said first fluid passage in fluid communication with a first external fluid;

(e) a second port for maintaining said second fluid passage in fluid communication with a second external fluid; and (f) means for regulating said member's temperature; wherein heat is transferred between said member and said element via solid conduction.

2. The heat exchanger of claim 1 further comprising a thermally conductive body having an outer surface disposed within said first passage and in thermal communication with said member, wherein heat is transferred between said member and said body via solid conduction.

3. The heat exchanger of claim 2 wherein at least one of said surfaces further comprises a means for enhancing turbulent flow in at least one of said passages; and wherein said housing further comprises a separate element threadably engaged in the lower portion of said housing.

4. The heat exchanger of claim 3 wherein said housing further comprises a duct for draining liquid from therein; and wherein said means for enhancing turbulent flow is at least one irregular surface area.

5. The heat exchanger of claim 4 wherein said housing is thermally non-conductive; wherein said irregular surface area is a threaded surface area; and wherein said means for regulating the temperature of said member comprises a thermoelectric device in thermal communication with said member and a heat reservoir and in signal communication with electric circuit means operative in response to a means for determining the temperature of said member.

6. The heat exchanger of claim 2 wherein said housing consists of at least an inner layer and an outer layer, said outer layer being thermally non-conductive and said inner layer being thermally conductive and in thermal communication with said member wherein heat is transferred between said member and said inner layer of said housing via solid conduction; wherein at least one of said surfaces further comprises a means for enhancing turbulent flow in at least one of said passages; and wherein said housing further comprises a separate element threadably engaged in the lower portion of said housing.

7. The heat exchanger of claim 6 wherein said housing further comprises a duct for draining liquid from therein; and wherein said means for enhancing turbulent flow is at least one irregular surface area.

8. The heat exchanger of claim 7 wherein said irregular surface area is a threaded surface area; and wherein said means for regulating the temperature of said member comprises a thermoelectric device in thermal communication with said member and a heat reservoir and in signal communication with electric circuit means operative in response to a means for determining the temperature of said member.

9. The heat exchanger of claims 5 or 8 wherein at least said outer surfaces possess a threaded surface area; and wherein said means for determining the temperature of said member is a thermally sensitive resistor in thermal communication with said member.

* * * * *